US011603736B2

(12) United States Patent
Helms et al.

(10) Patent No.: US 11,603,736 B2
(45) Date of Patent: Mar. 14, 2023

(54) BUOYANCY ASSIST TOOL WITH DEGRADABLE NOSE

(71) Applicant: Halliburton Energy Services, Inc., Houston, TX (US)

(72) Inventors: Lonnie C. Helms, Humble, TX (US); Min Mark Yuan, Katy, TX (US); Frank Vinicio Acosta, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 185 days.

(21) Appl. No.: 16/639,969

(22) PCT Filed: Apr. 15, 2019

(86) PCT No.: PCT/US2019/027502
§ 371 (c)(1),
(2) Date: Feb. 18, 2020

(87) PCT Pub. No.: WO2020/214145
PCT Pub. Date: Oct. 22, 2020

(65) Prior Publication Data

US 2021/0131221 A1 May 6, 2021

(51) Int. Cl.
*E21B 34/06* (2006.01)
*E21B 17/01* (2006.01)
(Continued)

(52) U.S. Cl.
CPC ..... *E21B 34/063* (2013.01); *E21B 17/012* (2013.01); *E21B 17/04* (2013.01); *E21B 34/08* (2013.01)

(58) Field of Classification Search
CPC ..... E21B 34/063; E21B 34/08; E21B 17/012; E21B 17/04
(Continued)

(56) References Cited

U.S. PATENT DOCUMENTS 3,463,351 A 8/1969 Mills
3,779,263 A 12/1973 Edwards et al.
(Continued)

FOREIGN PATENT DOCUMENTS

EP 0566290 A1 10/1993
EP 0681087 B1 9/2000
(Continued)

OTHER PUBLICATIONS

International Search Report and Written Opinion dated Oct. 27, 2020, issued in PCT Application No. PCT/US2020/039399.
(Continued)

*Primary Examiner* — Matthew R Buck
*Assistant Examiner* — Patrick F Lambe
(74) *Attorney, Agent, or Firm* — McAfee & Taft

(57) ABSTRACT

A downhole apparatus includes a casing string with a fluid barrier connected therein defining a lower end of a buoyancy chamber. A rupture disk is spaced from the fluid barrier and defines an upper end of the buoyancy chamber. A degradable plug is connected in the casing string above the rupture disk. The degradable plug defines a flow path to permit flow therethrough to the rupture disk, and is movable from a first to a second position in the casing string.

20 Claims, 5 Drawing Sheets

(51) Int. Cl.
*E21B 17/04* (2006.01)
*E21B 34/08* (2006.01)

(58) Field of Classification Search
USPC ..... 166/317
See application file for complete search history.

(56) References Cited

U.S. PATENT DOCUMENTS

| | | | | |
|---|---|---|---|---|
| 3,980,134 | A | 9/1976 | Amancharla | |
| 4,457,376 | A | 7/1984 | Carmody et al. | |
| 5,150,756 | A | 9/1992 | Hassanzadeh | |
| 5,479,986 | A | 1/1996 | Gano et al. | |
| 5,765,641 | A | 6/1998 | Shy et al. | |
| 5,826,661 | A | 10/1998 | Parker et al. | |
| 6,026,903 | A | 2/2000 | Shy et al. | |
| 6,076,600 | A * | 6/2000 | Vick, Jr. | E21B 33/1208 166/192 |
| 6,161,622 | A | 12/2000 | Robb et al. | |
| 6,324,904 | B1 | 12/2001 | Ishikawa et al. | |
| 6,450,263 | B1 | 9/2002 | Schwendemann | |
| 6,505,685 | B1 | 1/2003 | Sullaway et al. | |
| 6,622,798 | B1 | 9/2003 | Rogers et al. | |
| 6,651,748 | B2 | 11/2003 | Sullaway et al. | |
| 6,672,389 | B1 | 1/2004 | Hinrichs | |
| 6,758,281 | B2 | 7/2004 | Sullaway et al. | |
| 7,270,191 | B2 | 9/2007 | Drummond et al. | |
| 8,505,621 | B2 | 8/2013 | Telfer et al. | |
| 8,579,027 | B2 | 11/2013 | Abdelmalek et al. | |
| 9,033,055 | B2 | 5/2015 | Mccoy et al. | |
| 9,309,752 | B2 | 4/2016 | Talley et al. | |
| 9,441,437 | B2 | 9/2016 | Fripp et al. | |
| 9,441,446 | B2 | 9/2016 | Fripp et al. | |
| 9,518,445 | B2 | 12/2016 | Noske | |
| 9,540,904 | B2 | 1/2017 | Petrowsky | |
| 9,593,542 | B2 | 3/2017 | Getzlaf et al. | |
| 10,138,707 | B2 | 11/2018 | Tolman et al. | |
| 10,323,478 | B2 | 6/2019 | Berscheidt et al. | |
| 2002/0185273 | A1 | 12/2002 | Aronstam et al. | |
| 2003/0116324 | A1 | 6/2003 | Dawson et al. | |
| 2003/0217844 | A1 | 11/2003 | Moyes | |
| 2008/0029273 | A1 | 2/2008 | Pia | |
| 2008/0073075 | A1* | 3/2008 | Buyers | E21B 33/1208 166/188 |
| 2008/0115942 | A1 | 5/2008 | Keller et al. | |
| 2010/0270031 | A1 | 10/2010 | Patel | |
| 2010/0294376 | A1 | 11/2010 | O'Brien et al. | |
| 2011/0042099 | A1 | 2/2011 | Williamson, Jr. et al. | |
| 2011/0253392 | A1 | 10/2011 | May et al. | |
| 2012/0111566 | A1 | 5/2012 | Sherman et al. | |
| 2014/0174757 | A1* | 6/2014 | Fripp | E21B 29/02 166/376 |
| 2014/0216756 | A1 | 8/2014 | Getzlaf et al. | |
| 2014/0224505 | A1 | 8/2014 | Ramon | |
| 2014/0338923 | A1* | 11/2014 | Fripp | E21B 33/1208 166/376 |
| 2015/0107843 | A1 | 4/2015 | Talley et al. | |
| 2015/0129205 | A1 | 5/2015 | Hofman et al. | |
| 2015/0240596 | A1 | 8/2015 | Horwell | |
| 2016/0177668 | A1 | 6/2016 | Watson et al. | |
| 2016/0333658 | A1* | 11/2016 | Keshishian | E21B 37/10 |
| 2017/0096875 | A1 | 4/2017 | Ravensbergen et al. | |
| 2017/0138153 | A1 | 5/2017 | Getzlaf et al. | |
| 2018/0003004 | A1 | 1/2018 | Norman et al. | |
| 2018/0058179 | A1 | 3/2018 | Nuryaningsih et al. | |
| 2018/0080308 | A1 | 3/2018 | Dedman et al. | |
| 2018/0219200 | A1 | 8/2018 | Albukrek et al. | |
| 2018/0262127 | A1 | 9/2018 | Gooneratne et al. | |
| 2018/0371869 | A1 | 12/2018 | Kellner et al. | |
| 2019/0128081 | A1 | 5/2019 | Ross et al. | |
| 2019/0352994 | A1 | 11/2019 | Giroux | |
| 2019/0352995 | A1 | 11/2019 | Giroux et al. | |
| 2021/0062598 | A1* | 3/2021 | Yuan | E21B 34/063 |

FOREIGN PATENT DOCUMENTS

| | | | |
|---|---|---|---|
| JP | 6551001 | B2 | 7/2019 |
| WO | 2014098903 | A1 | 6/2014 |
| WO | 2015073001 | A1 | 5/2015 |
| WO | 2016176643 | A1 | 11/2016 |
| WO | 2019099046 | A1 | 5/2019 |

OTHER PUBLICATIONS

International Search Report and Written Opinion dated Feb. 24, 2021, issued in PCT Application No. PCT/US2020/040157.
International Search Report and Written Opinion dated Jan. 14, 2020, which issued in corresponding PCT Application No. PCT/US2019/027502.
International Search Report and Written Opinion dated Aug. 14, 2018, issued in PCT Application No. PCT/US2017/062528.
International Search Report and Written Opinion dated Sep. 19, 2019, issued in PCT Application No. PCT/US2018/066889.
International Search Report and Written Opinion dated Sep. 19, 2019, issued in PCT Application No. PCT/US2018/067161.
International Search Report and Written Opinion dated Aug. 14, 2019, issued in PCT Application No. PCT/US2019/064051.
International Search Report and Written Opinion dated Feb. 5, 2020, issued in PCT Application No. PCT/US2019/031541.
International Search Report and Written Opinion dated Jan. 16, 2020, issued in PCT Application No. PCT/US2019/027625.
International Search Report and Written Opinion dated Jan. 21, 2020, issued in PCT Application No. PCT/US2019/028508.
International Search Report and Written Opinion dated May 25, 2020, issued in PCT Application No. PCT/US2019/056206.
International Search Report and Written Opinion dated May 26, 2020, issued in PCT Application No. PCT/US2019/059757.
International Search Report and Written Opinion dated Jul. 21, 2020, issued in PCT Application No. PCT/US2019/059864.
International Search Report and Written Opinion dated Jul. 23, 2020, issued in PCT Application No. PCT/US2019/061714.
International Search Report and Written Opinion dated Aug. 11, 2020, issued in PCT Application No. PCT/US2019/065862.
International Search Report and Written Opinion dated Aug. 31, 2020, issued in PCT Application No. PCT/US2020/012307.

* cited by examiner

BUOYANCY ASSIST TOOL WITH DEGRADABLE NOSE

BACKGROUND

The length of deviated or horizontal sections in well bores is such that it is sometimes difficult to run well casing to the desired depth due to high casing drag. Long lengths of casing create significant friction and thus problems in getting casing to the toe of the well bore. Creating a buoyant chamber in the casing utilizing air or a fluid lighter than the well bore fluid can reduce the drag making it easier to overcome the friction and run the casing to the desired final depth.

DETAILED DESCRIPTION

Figure 1:
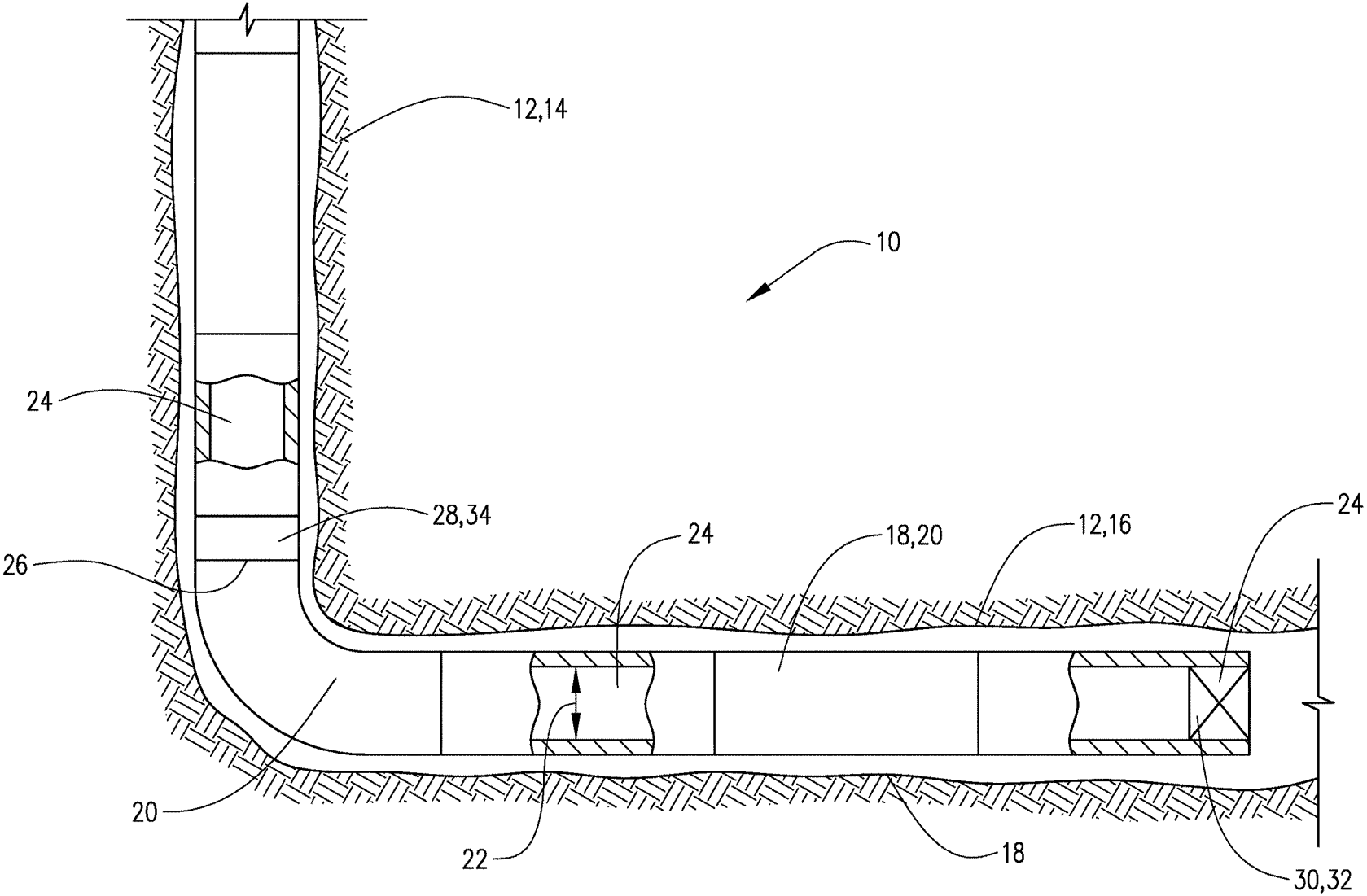
FIG. 1 is a schematic view of an exemplary well bore with a well casing including a buoyancy chamber therein.

The following description and directional terms such as above, below, upper, lower, uphole, downhole, etc., are used for convenience in referring to the accompanying drawings. One who is skilled in the art will recognize that such directional language refers to locations in the well, either closer or farther from the wellhead and the various embodiments of the inventions described and disclosed here may be utilized in various orientations such as inclined, deviated, horizontal and vertical.

Referring to the drawings, a downhole apparatus 10 is positioned in a well bore 12. Well bore 12 includes a vertical portion 14 and a deviated or horizontal portion 16. Apparatus 10 comprises a casing string 18 which is made up of a plurality of casing joints 20. Casing joints 20 may have inner diameter or bore 22 which defines a central flow path 24 therethrough. Well casing 18 defines a buoyancy chamber 26 with upper end or boundary 28 and lower end or boundary 30. Buoyancy chamber 26 will be filled with a buoyant fluid which may be a gas such as nitrogen, carbon dioxide, or air but other gases may also be suitable. The buoyant fluid may also be a liquid such as water or diesel fuel or other like liquid. The important aspect is that the buoyant fluid has a lower specific gravity than the well fluid in the well bore 12 in which casing 18 is run. The choice of gas or liquid, and which one of these is used is a factor of the well conditions and the amount of buoyancy desired.

Lower boundary 30 may comprise a float device such as a float shoe or float collar. As is known, such float devices will generally allow fluid flow downwardly therethrough but will prevent flow upwardly into the casing. The float devices are generally a one-way check valve. The float device 30 is thus a fluid barrier that will be configured such that it will hold the buoyant fluid in the buoyancy chamber 26 until additional pressure is applied after the release of the buoyancy fluid from the buoyancy chamber. The upper boundary 28 is defined by a buoyancy assist tool as described herein.

Buoyancy assist tool 34 comprises an outer case 36 with upper end 38 and lower end 40. Upper and lower ends 38 and 40 are connectable in casing string 18 in a manner known in the art. For example, upper and lower ends 38 and 40 may be threaded so as to threadably connect in casing string 18, such that outer case 36 comprises a part of casing string 18. Outer case 36 has inner surface 42 that defines a central flow passage 44 therethrough. Outer case 36 has an inner diameter 46 that includes a first inner diameter 48. First inner diameter 48 may be a minimum inner diameter 48. A second inner diameter 50 is larger than first inner diameter 48 and a shoulder 52 is defined by and between first and second inner diameters 48 and 50 respectively. Shoulder 52 is an upward facing shoulder.

Figure 4:
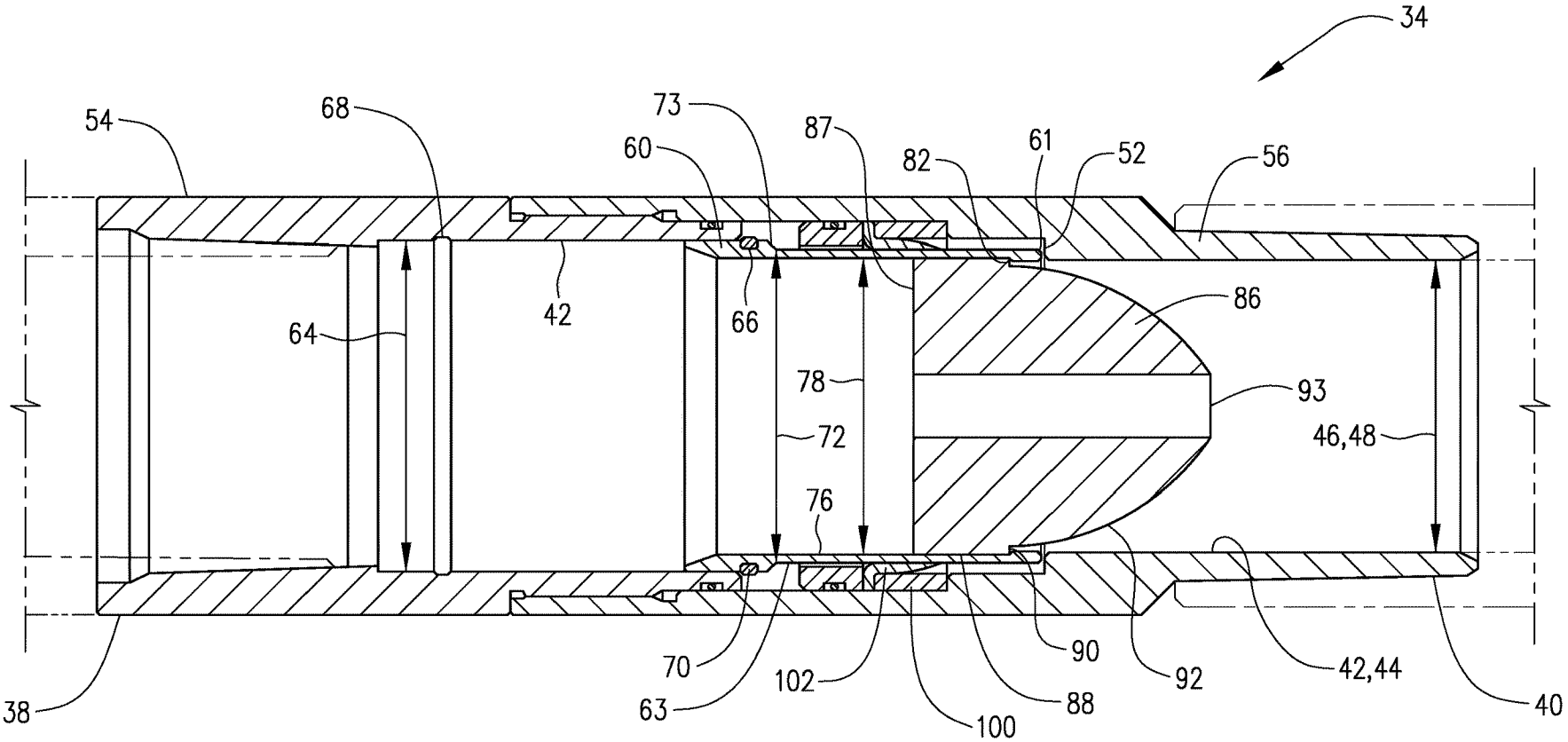
FIG. 4 is a cross section after the sleeve and the degradable plug of the buoyancy assist tool have moved into a second position.

Outer case 36 comprises an upper outer case 54 and a lower outer case 56 threadably connected to one another. A sleeve 60 with lower end 61 is positioned in outer case 36 and is detachably connected therein. Sleeve 60 is movable from the first position shown in FIG. 2 to the second position shown in FIG. 4. Sleeve 60 is held in place in the first position by means known in the art. For example, sleeve 60 has outer surface 63 defining first outer diameter 64 and second outer diameter 72. A shoulder 73, which is a downward facing shoulder 73, is defined by and between first and second outer diameters 64 and 72. Sleeve 60 has a head portion 62 with outer diameter 64 at an upper end 74 thereof. A groove 66 is defined in the outer surface 63 of sleeve 60 and specifically is defined on outer surface 63 in first outer diameter 64. A corresponding groove 68 is defined on the inner surface 42 of outer case 36.

Figure 2:
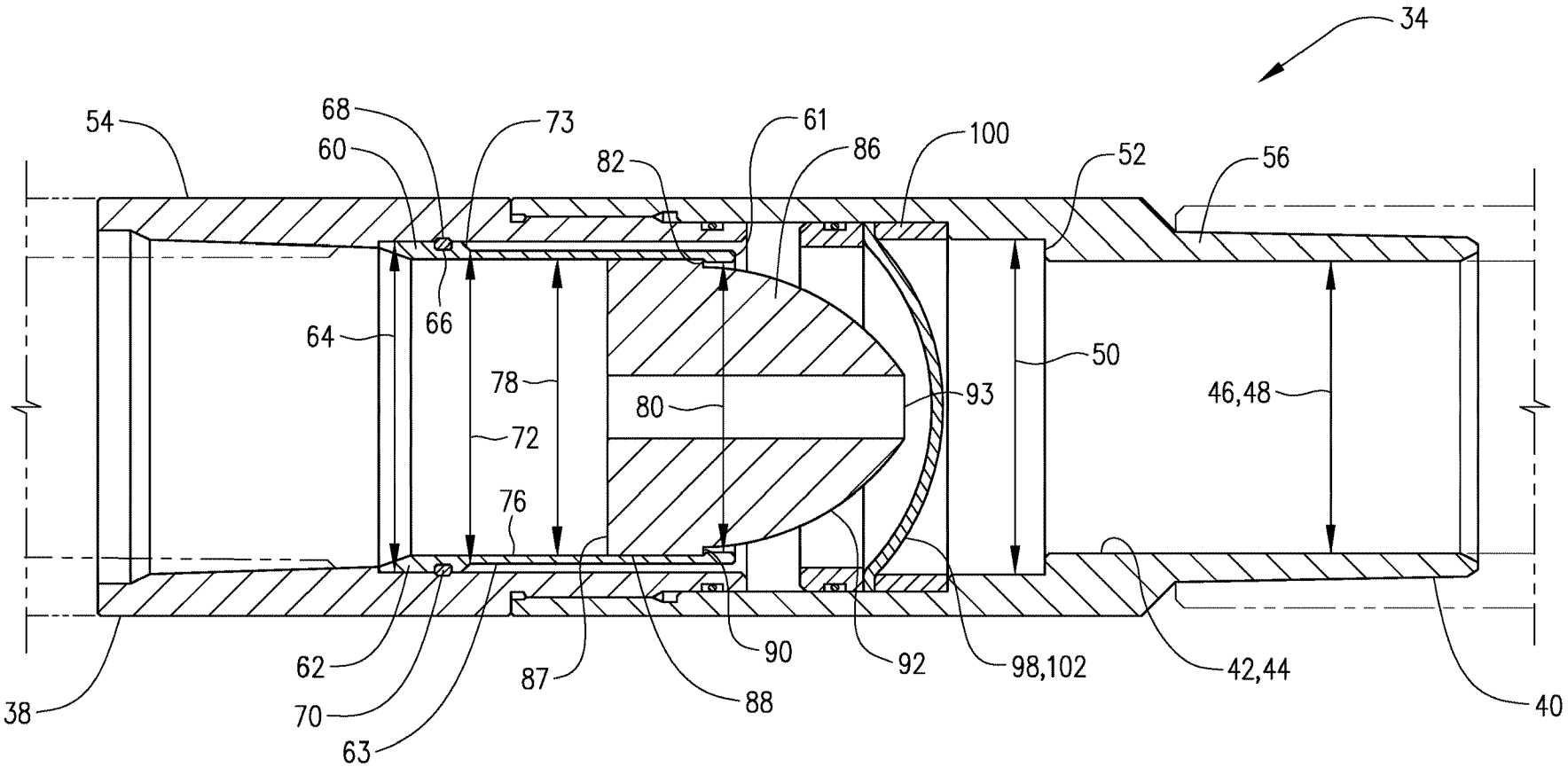
FIG. 2 is a cross section of a buoyancy assist tool of the current disclosure in a first position.

FIG. 2 shows sleeve 60 in the first position. Sleeve 60 is held in the first position by a lock ring 70 which may be of a type known in the art. Lock ring 70 is received in grooves 66 and 68 and will hold sleeve 60 in place in the first position until a predetermined pressure is reached as will be explained hereinbelow. Sleeve 60 has a second outer diameter 72 thereon. A shoulder 73, which is a downward facing shoulder 73, is defined by and between first and second outer diameters 64 and 72. Sleeve 60 has an inner surface 76 that defines first and second inner diameters 78 and 80, respectively. A shoulder 82, which is an upward facing shoulder 82, is defined by and between first and second inner diameters 78 and 80.

A dissolvable or degradable plug 86 is disposed in outer case 36 and is held in place in the first position by sleeve 60. Degradable plug 86 is made of a degradable material, which may be, in a non-limiting example, a degradable metallic material. There are a number of materials, for example magnesium alloys, aluminum, magnesium, aluminum-magnesium alloy, iron and alloys thereof, may be used for degradable plug 86. Such materials are known to be degradable with fluids pumped downhole, for example fresh water, salt water, brine, seawater or combinations thereof. Degradable plug 86 is movably connected in the casing string 18 from the first position shown in FIG. 2 to the second position shown in FIG. 4. Degradable plug 86 may comprise an upper surface 87. Degradable plug 86 has a base 88 which may be a circular or ring-shaped base 88. A nose cone 92 extends from base 88 in a longitudinal direction and extends radially inwardly and arcuately from base 88 to form the nose cone 92. Base 88 defines a downward facing shoulder 90 thereon. Downward facing shoulder 90 will engage upward facing shoulder 82 on sleeve 60.

A rupture disk 98 comprising a rupture disk base 100 and a rupture disk membrane 102 is mounted in outer case 36 and is positioned below a bottom end 93 of nose cone 92. Fluid passing through a flow path 96 defined in degradable plug 86 will impact upon ruptured disk 98. Rupture disk membrane 102 will rupture, or burst at a predetermined pressure.

In operation, casing 18 is lowered into the well bore 12 to a desired location.

Running a casing such as casing string 18 in a deviated well along horizontal wells often results in significantly increased drag forces that may cause a casing string to become stuck before reaching the desired location in the well bore. For example, when the casing string 18 produces more drag forces than any available weight to slide the casing string 18 down the well, the casing string may become stuck. If too much force is applied damage may occur to the casing string. The buoyancy assist tool 34 described herein alleviates some of the issues and at the same time provides for a full bore passageway so that other tools or objects such as, for example production packers, perforating guns and service tools may pass therethrough without obstruction after well casing 18 has reached the desired depth. When well casing 18 is lowered into well bore 12 buoyancy chamber 26 will aid in the proper placement since it will reduce friction as the casing 18 is lowered into the horizontal portion 16 to the desired location.

Figure 3:
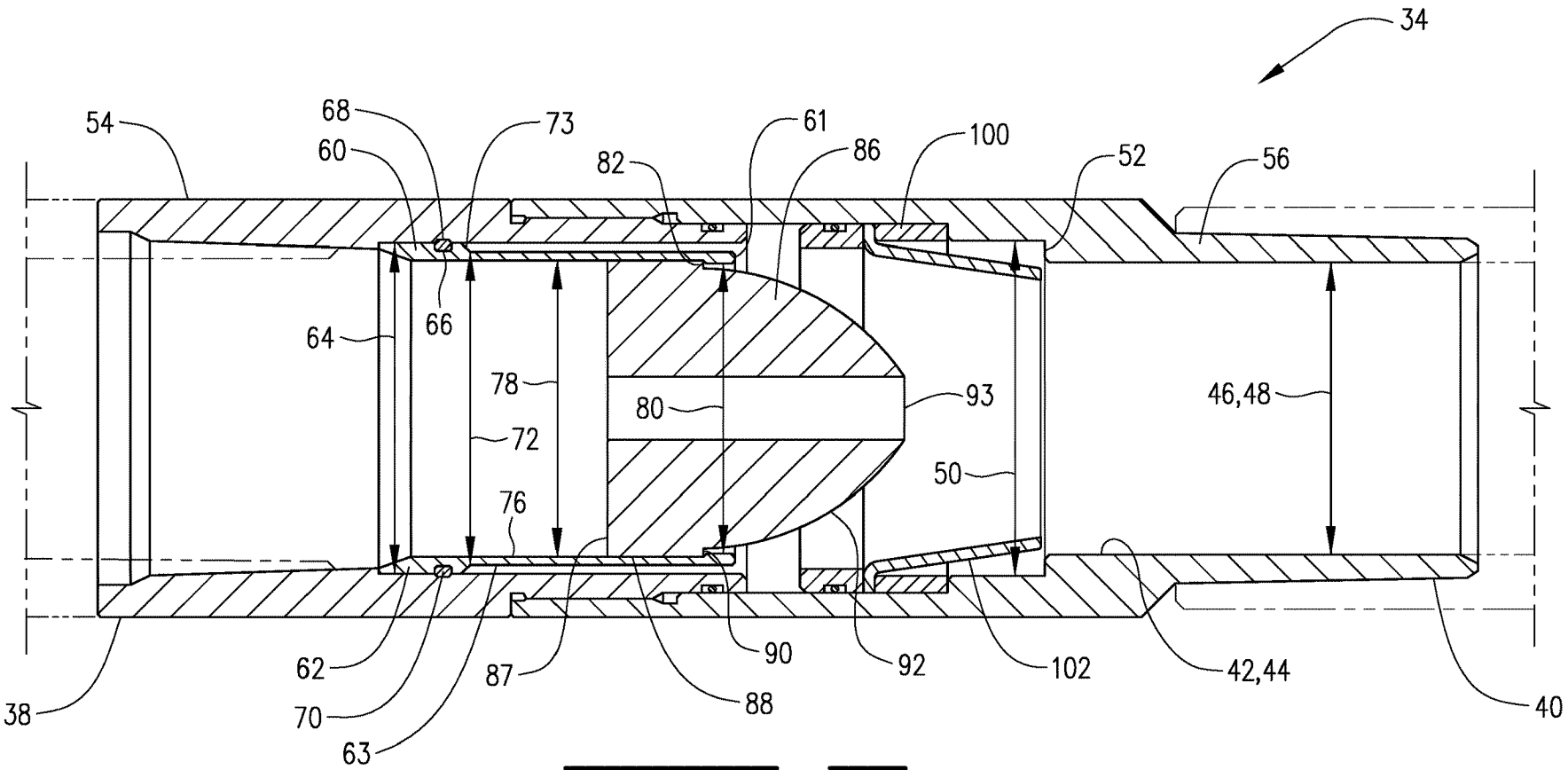
FIG. 3 is a cross section of the buoyancy assist tool of FIG. 2 after the rupture disk has ruptured.

Once casing string 18 with buoyancy chamber 26 has reached the desired position in the well bore, pressure will be increased in the casing string. A degrading fluid will be pumped through casing string 18 and will pass through flow path 96 in degradable plug 86. When the predetermined rupture pressure for rupture disk 98 is reached in the casing, rupture disk membrane 102 will be burst. FIG. 3 shows the rupture disk 98 after the predetermined pressure has been reached. In FIG. 3 buoyancy assist tool 34 is still in the first position which is the first position of the sleeve 60 and the degradable plug 86.

Once the rupture disk membrane 102 has ruptured fluids flowing downward through casing string 18 will continue to impact upon upper surface 87 of degradable plug 86. The fluid will provide a downward directed force such that plug 86 will be urged downwardly. Once the predetermined pressure, or force needed to move sleeve 60 is reached as a result of the fluid flow sleeve 60 will detach, or disconnect from outer case 36. Plug 86 will move downwardly to the second position shown in FIG. 4 and will pull sleeve 60 downward to the second position. As the sleeve 60 moves downwardly it will force the ruptured rupture disk membrane 102, which may also be referred to as rupture disk petals, radially outwardly and will trap the ruptured rupture disk membrane 102 against the inner surface of the outer case 36. The lower end 61 of sleeve 60 will engage upward facing shoulder 52 which will stop the downward movement of plug 86 and will hold plug 86 in the second position shown in FIG. 4.

Figure 5:
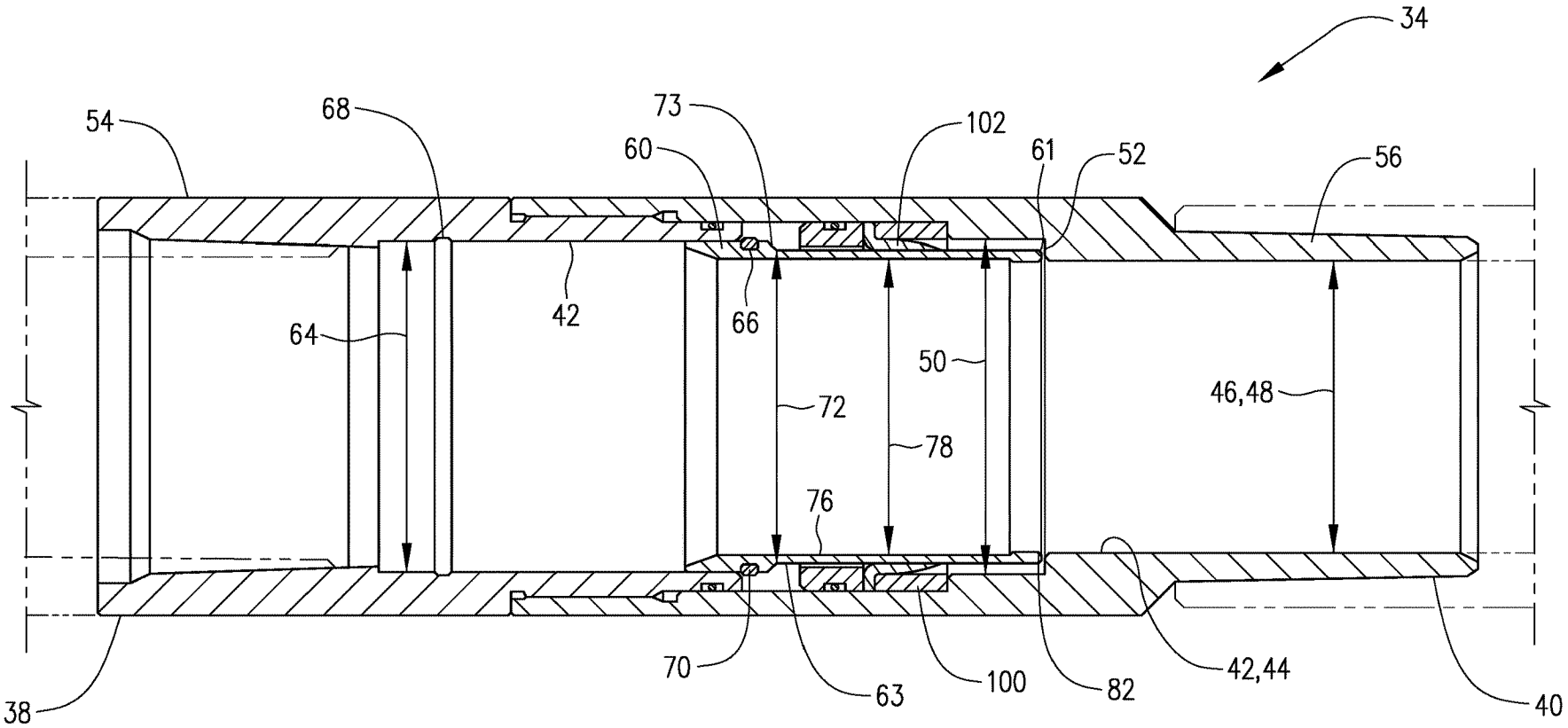
FIG. 5 is a cross-section view of the buoyancy assist tool after the degradable plug has been completely dissolved leaving an open bore through the buoyancy assist tool.

Continued flow of degradable fluid through casing string 18 and through central flow path 96 defined in degradable plug 86 will completely degrade plug 86 such that as shown in FIG. 5 a completely open passage is provided for the passage of tools therethrough as described herein. The only restriction will be the minimum diameter of the casing string 18 which may be for example an inner diameter of a casing joint 18 or for example inner diameter 48 of outer case 36. In any event buoyancy assist tool 34 defines the upper boundary of buoyancy chamber 26, and provides no restriction on the size of tools that can pass therethrough that did not already exist as a result of the inner diameter of the casing string 18.

A downhole apparatus comprising a casing string with a fluid barrier connected in the casing string is disclosed. The fluid barrier defines a lower end of a buoyancy chamber in the casing string. A rupture disk configured to rupture at a predetermined pressure is spaced from the fluid barrier and defines an upper end of the buoyancy chamber. A degradable plug is movably connected in the casing string above the rupture disk. The degradable plug defines a flow path to permit flow therethrough to the rupture disk.

The degradable plug is movable from a first position to a second position in the casing string. In the second position the rupture disk membrane of the rupture disk is moved radially outwardly out of a flow passage through the casing. The degradable plug is configured to completely degrade after it has moved to the second position. A sleeve is detachably connected in the casing string, and configured to hold the degradable plug in the first position until the rupture disk has ruptured. The degradable plug is configured to pull the sleeve downward to the second position after the rupture disk has ruptured. The sleeve engages the casing to hold the plug in the second position. In one embodiment the degradable plug comprises a circular base and a nose cone extending longitudinally therefrom. The nose cone may taper radially inwardly from the circular base to a lower end thereof.

In one embodiment a buoyancy assist tool comprises an outer case configured to be connected at an upper end and a lower end to a casing string. A rupture disk comprising a rupture disk housing and a rupture disk membrane is mounted in the outer case. The rupture disk is configured to rupture at a predetermined pressure. A degradable plug is positioned in the outer case above the rupture disk. The degradable plug defines a longitudinal flow path therethrough, and is movable from a first position to a second position in the outer case after the rupture disk ruptures.

The buoyancy assist tool may comprise a sleeve detachably mounted in the outer case. The sleeve is configured to detach from the outer case when a second predetermined pressure is reached after the rupture disk ruptures. The sleeve holds the degradable plug in the second position as degrading fluid passes through the outer case and the flow path in the degradable plug and degrades the plug. The sleeve is configured to urge the rupture disk membrane out of a flow passage of the outer case in the second position of the degradable plug. The plug may comprise a circular base disposed in the sleeve and a nose cone extending downwardly from the circular base. The degradable plug completely degrades in the second position.

A casing string of the current disclosure comprises a plurality of casing joints. A fluid barrier is connected in one of the casing joints and defines a lower end of a buoyancy chamber. A buoyancy assist tool is connected in the casing string and defines an upper end of the buoyancy chamber. The buoyancy assist tool comprises an outer case connected in the casing string. A degradable plug is mounted in the outer case and is movable from a first position to a second position therein. A rupture disk is mounted in the outer case below the degradable plug. The degradable plug defines a flow path therethrough to permit flow to pass therethrough to the rupture disk.

The casing string in one embodiment comprises a sleeve detachably connected in the outer case and configured to hold the degradable plug in the first position until the rupture disk ruptures. The degradable plug is configured to engage the sleeve and pull the sleeve to the second position. The sleeve is configured to urge a rupture disk membrane of the rupture disk out of a flow passage through the outer case in the second position. The degradable plug is held in the second position by the sleeve until the degradable plug completely degrades.

Thus, it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention.

What is claimed is:

1. A downhole apparatus comprising:

a casing string;

a fluid barrier connected in the casing string, the fluid barrier defining a lower end of a buoyancy chamber in the casing;

a rupture disk configured to rupture at a predetermined pressure spaced from the fluid barrier and defining an upper end of the buoyancy chamber in the casing; and a degradable plug connected in the casing string above and spaced apart from the rupture disk, the degradable plug defining a flow path therethrough to permit flow therethrough to the rupture disk and movable longitudinally in the casing.

2. The downhole apparatus of claim 1, the degradable plug being movable from a first position to a second position in the casing string, wherein in the second position a rupture disk membrane of the rupture disk is moved radially outwardly out of a flow passage through the casing.

3. The downhole apparatus of claim 2, the degradable plug being completely degradable after it has moved to the second position.

4. The downhole apparatus of claim 1 further comprising a sleeve detachably connected in the casing string, the sleeve engaged with the degradable plug to hold the degradable plug in the first position until the rupture disk has ruptured.

5. The downhole apparatus of claim 4, the engagement of the sleeve with the degradable plug sufficient to pull the sleeve downward to the second position after the rupture disk has ruptured, wherein the sleeve engages the casing string to hold the degradable plug in the second position.

6. The downhole apparatus of claim 4, wherein the sleeve captures a rupture disk membrane of the rupture disk between the casing string and the sleeve in the second position of the degradable plug.

7. The downhole apparatus of claim 1, the degradable plug comprising a circular base and a nose cone extending longitudinally therefrom, the nose cone tapering radially inwardly from the circular base cone to a lower end of the nose cone, the nose cone defining an arcuate taper.

8. A downhole apparatus comprising:

an outer case configured to be connected at an upper end and a lower end in a casing string;

a rupture disk comprising a rupture disk base and a rupture disk membrane mounted in the outer case, the rupture disk membrane configured to rupture at a predetermined pressure; and a degradable plug positioned in the outer case above the rupture disk and defining a longitudinal flow path therethrough, the degradable plug movable from a first position to a second position in the outer case after the rupture disk ruptures.

9. The downhole apparatus of claim 8 further comprising a sleeve detachably mounted in the outer case, the sleeve being detachable from the outer case after the rupture disk ruptures.

10. The downhole apparatus of claim 9, wherein the sleeve holds the degradable plug in the second position as degrading fluid passes through the outer case and the flow path in the degradable plug and degrades the plug.

11. The downhole apparatus of claim 9, wherein the sleeve urges the rupture disk membrane out of a flow passage of the outer case in the second position of the degradable plug.

12. The downhole apparatus of claim 8, the plug comprising a circular base disposed in the sleeve and a nose cone extending downwardly from the circular base.

13. The downhole apparatus of claim 8, wherein the degradable plug completely degrades in the second position.

14. A downhole apparatus comprising:

a plurality of casing joints;

a fluid barrier connected in one of the casing joints and defining a lower end of a buoyancy chamber; and a buoyancy assist tool connected to a casing joint and defining an upper end of the buoyancy chamber, the buoyancy chamber comprising a plurality of casing joints between the buoyancy assist tool and the fluid barrier, the buoyancy assist tool comprising:

an outer case connected to a casing joint at the upper and lower ends thereof;

a degradable plug connected in the outer case and movable from a first position to a second position therein; and a rupture disk mounted in the outer case below the degradable plug, the degradable plug defining a flow path therethrough to permit flow to pass therethrough to the rupture disk.

15. The downhole apparatus of claim 14 further comprising a sleeve detachably connected in the outer case and attached to the degradable plug, wherein the sleeve holds the degradable plug in the first position until the rupture disk ruptures.

16. The downhole apparatus of claim 15, the degradable plug engaging the sleeve to pull the sleeve to the second position after the rupture disk ruptures.

17. The downhole apparatus of claim 15, the degradable plug comprising a circular base with a radially inwardly tapering nose cone extending therefrom.

18. The downhole apparatus of claim 15, the sleeve configured to urge a rupture disk membrane of the rupture disk out of a flow passage through the outer case in the second position of the degradable plug.

19. The downhole apparatus of claim 15, a rupture disk membrane of the rupture disk being captured between the sleeve and the outer case in the second position of the degradable plug.

20. The downhole apparatus of claim 14, wherein the degradable plug is held in the second position by the sleeve until the degradable plug completely degrades.

* * * * *